US005200569A

United States Patent [19]

Moore

[11] Patent Number: 5,200,569

[45] Date of Patent: Apr. 6, 1993

[54] MUSICAL INSTRUMENT PICKUP SYSTEMS AND SUSTAINER SYSTEMS

[76] Inventor: Steven M. Moore, 514 142nd Ave. SE., 98, Bellevue, Wash. 98007

[21] Appl. No.: 538,240

[22] Filed: Jun. 14, 1990

Related U.S. Application Data

[60] Continuation-in-part of Ser. No. 407,857, Sep. 15, 1989, abandoned, which is a division of Ser. No. 199,851, May 27, 1988, Pat. No. 4,907,483.

[51] Int. Cl.[5] ..... G10H 3/18

[52] U.S. Cl. ..... 84/723; 84/726; 84/DIG. 10

[58] Field of Search ..... 84/723-742, 84/DIG. 10

[56] References Cited

U.S. PATENT DOCUMENTS

| | | | |
|---|---|---|---|
| 4,408,513 | 10/1983 | Clevinger | 84/726 |
| 4,484,508 | 11/1984 | Nourney | 84/DIG. 10 |
| 4,499,809 | 2/1985 | Clevinger | 84/726 |
| 5,070,759 | 12/1991 | Hoover et al. . | |

*Primary Examiner*—Stanley J. Witkowski
*Attorney, Agent, or Firm*—Lerner, David, Littenberg, Krumholz & Mentlik

[57] ABSTRACT

A pickup system for providing sounds for a musical instrument has a feedback circuit for converting a pickup signal representing a vibration of a string or other vibratory element to a drive signal. The pickup system includes a pickup coil, an electromagnetic source which generates a magnetic flux, a device such as a ferromagnetic element for magnetically linking the electromagnetic source and the pick up coil with the vibratory element, a step-up transformer having a primary coil section and secondary coil section, a connection between the pickup coil and the primary coil section of the step-up transformer, an output terminal and circuit elements for connecting the output terminal to the secondary coil section of the step-up transformer. Preferably, the pickup system includes a sustainer having a sustain feedback circuit for accepting a feedback signal which represents the motion of the vibratory element wherein the sustain feedback circuit includes an operational amplifier, a first and a second network and a switch for selectively directing the feedback signal through one of the networks to one of two input terminals of the operational amplifier. In another preferred embodiment, a sustainer for a musical instrument includes a switchable sustain circuit having an inverting and non-inverting signal path which have different frequency response characteristics.

9 Claims, 2 Drawing Sheets

AGC/INTESITY
THRESHOLD
POWER AMP
MODE SELECT
PHASE/GAIN
BATTERY STATUS
SELECTOR
VCC
VEE
OUT
DIS
GND
CW

MUSICAL INSTRUMENT PICKUP SYSTEMS AND SUSTAINER SYSTEMS

CROSS-REFERENCE TO RELATED APPLICATIONS

The present application is a continuation in part of U.S. patent application No. 07/407,857, filed Sep. 15, 1989, and now abandoned which in turn is a division of U.S. patent application No. 07/199,851, filed May 27, 1988, now U.S. Pat. No. 4,907,483. The disclosure of said 4,907,483 patent is hereby incorporated by reference herein.

BACKGROUND OF THE INVENTION

The present invention relates to the art of musical instruments, and more particularly relates to pickups and sustainers for use with musical instruments having vibratory elements such as strings.

Many conventional musical instruments utilize strings or other vibratory elements to produce sound. In the traditional versions of such instruments, the vibration of the string or other element is directly converted into sound, through acoustic coupling between the vibratory element and the air. Typically, the body of the conventional instrument has significant acoustic response and aids in conversion of the vibration to sound. In the so-called "electric" versions of such instruments, the vibration of the element is converted to electrical signals by transducers, commonly referred to as "pickups", and these electrical signals are amplified and reproduced by loudspeakers. Several pickups may be provided, and the electrical signals may be derived from any one of these pickups or from a blend of signals from more than one pickup. For example, in a stringed musical instrument, the various pickups may be disposed at spaced apart locations along the length of the string to detect the different motions of different sections of the string.

Electromagnetic pickups are commonly employed for this purpose. Each electromagnetic pickup typically includes a permanent magnet and at least one coil. The coil and permanent magnet are mounted to the instrument body in proximity to ferromagnetic strings of the instrument so that flux from the magnet is linked to the coil via a magnetic path including the strings. As the strings vibrate, they alter the magnetic reluctance of the path and hence alter the amount of flux passing through the coil, so that signal voltages are induced in the coil responsive to the vibration.

Pickups utilized heretofore have been designed to maximize the signal voltage. Such pickup coils typically include thousands of turns and have very high inductance, ordinarily about 2.5–10 Henries. These coils, and the pickups incorporating the same are expensive. The problem is particularly severe in the case of an instrument incorporating plural pickups.

Devices referred to as sustainers have also been employed heretofore in conjunction with electric musical instruments such as electric guitars. The sustainer normally incorporates an electromagnetic transducer referred to as a "driver" for applying forces to the vibratory element of the instrument in response to an electrical signal. The sustainer also includes a feedback circuit for accepting a signal representing motion of the string, such as a signal from a pickup, and transmitting the feedback signal to the driver, typically with substantial amplification. Thus, the forces applied by the driver tend to reinforce the motion of the vibratory element or string and hence to sustain its vibration. The aforementioned patents and patent applications disclose particularly useful designs for such sustainers. The sustainers are arranged to compensate for phase shifts in the driver and/or pickup and thus assure that the driving forces applied by the driver to the string or other vibratory element are substantially in phase with the vibration. This provides a particularly effective sustain action.

A driver typically is designed according to criteria different from those employees in design of a pickup. A driver ordinarily is a low impedance devices with a coil having a relatively small number of turns and a relatively low inductance, typically about 3 milliHenries. These devices may include a core of magnetically "soft" material, i.e., a material of high magnetic permeability such as iron. These characteristics provide high efficiency in conversion of the electrical feedback signal to force applied to the strings. Typically, the driver is provided in addition to all of the pickups incorporated in the instruments, thus further adding to the cost of the instrument. The driver may be positioned on the instrument at a location which would otherwise be occupied by a pickup. This makes it impractical to provide a pickup at that location.

Sustainers have been provided heretofore with phase inversion devices, or with selectable diodes in the feedback circuit for selectively inverting the feedback signal. This reverses the phase relationship between the drive force applied by the driver and the vibration of the string. See U.S. Pat. Nos. 3,813,473; Reissue 25,728; 4,245,540. Use of the feedback signal without phase inversion tends to reinforce the fundamental mode vibration of a string, whereas use of the feedback signal with phase inversion tends to reinforce harmonics in vibration of the string. The selectively operable phase inversion device allows the musician to choose either effect. However, the frequency and phase response of the feedback circuit (apart from the inversion) is the same. This represents a compromise at best. The optimum response for driving the fundamental is different from the optimum frequency response for driving the harmonics.

Accordingly, there have been substantial, unmet needs for further improvements in musical instruments, and particularly in pickup systems, sustainers and musical instruments incorporating these elements.

SUMMARY OF THE INVENTION

The present invention addresses these needs.

One aspect of the present invention provides a pickup system for a musical instrument having at least one vibratory element. A pickup system according to this aspect of the present invention preferably includes a pickup coil, means for generating a magnetic flux and flux linkage means for magnetically linking the flux generating means and the pickup coil with at least one vibratory element of the instrument for transmission of magnetic flux there between. The pickup coil preferably is a relatively low inductance coil having an inductance less than about 200 milliHenries, and including about 1500 turns or less and most desirably has an inductance of about 8 milliHenries or less and about 300 turns or less. Most preferably, the pickup coil includes between about 50 about 150 turns, such as about 100 turns, and has an inductance of about 5 milliHenries or less, typically about 1 milliHenry. The flux linkage means may include a ferromagnetic element such as a soft iron core and the coil may be wound around the core. A pickup system according to this aspect of the present invention incorporates a step up transformer having a primary coil section and a secondary coil section, the secondary coil section having a greater number of turns than the primary coil section, the primary and secondary coil sections being linked for transmission of magnetic flux therebetween. The primary and secondary coil sections may be formed as entirely separate windings as in a conventional transformer, or else may be parts of a single winding so that some turns of the winding serve as parts of both the primary and secondary coil sections. This latter construction is commonly referred to as an "autotransformer". The pickup system also includes an output terminal, means for electrically connecting the secondary coil section to the output terminal and means for electrically connecting the pickup coil to the primary coil section.

Although the pickup coil provides relatively low voltage signals, these voltages are stepped up by the transformer so that the system provides output voltages comparable to those achieved with conventional high inductance pickups. This arrangement provides significant cost and performance benefits. With regard to cost, the arrangement according to the present invention would not appear to offer any advantage, inasmuch as it incorporates all of the windings of the transformer in addition to those incorporated in the pickup. However, the total cost of a system in accordance with the present invention ordinarily is considerably less than the cost of a conventional high inductance pickup providing comparable signal voltages. The windings of a pickup coil must be physically configured to match the physical configuration of the instrument. For example, where the pickup includes a single large winding to sense the motions of a plurality of strings, that winding typically is applied on a large rectangular core. Moreover, the physical placement of windings on a pickup core must be carefully controlled during the winding process. All of these factors make each turn on the pickup itself relatively expensive. By contrast, signal transformers are fabricated in large numbers for many diverse uses, and are commercially available at very low cost. A winding in a transformer typically costs considerably less than a winding on a pickup. Moreover, because the transformer is configured solely for optimum inductive properties, it can provide high efficiency in the primary and secondary coils with relatively small numbers of turns. As further discussed below, one transformer may serve plural pickup coils, thus further decreasing the cost of the system.

Pickup systems according to this aspect of the present invention also provide substantial performance benefits. Conventional pickups mounted on an instrument ordinarily are connected to amplifiers via cables selected by the musician. These cables ordinarily have a coaxial shield surrounding the signal-carrying conductor, and hence have a substantial capacitance. With the conventional pickup, this capacitance is connected directly in parallel with the pickup coil. The pickup coil and cable capacitance form a resonant circuit with substantially different response at different frequencies. The frequency response of such a system depends on the particular cable selected by the musician. By contrast, in a system according to this aspect of the present invention, the pickup coil is effectively isolated from the capacitance of the cable. The primary coil side circuit, incorporating the pickup coil and the primary coil of the transformer, has a preselected capacitance. Its characteristics are selected to provide the desired frequency response, and are substantially uninfluenced by the characteristics of the cable used to connect the output terminal to the amplifier. Moreover, a pickup system according to this aspect of the present invention can provide lower noise than a conventional pickup.

According to a further aspect of the present invention, the means for connecting the pickup coil to the primary coil of the transformer includes switching means for selectively connecting the pickup coil to a sustain signal input terminal. The switching means preferably are arranged to disconnect the pickup coil from the primary coil of the transformer when the pickup coil is connected to the sustain signal input terminal. Most preferably, a pickup system according to this aspect of the present invention is utilized in conjunction with sustain pickup means for detecting motion of the vibratory element and drive signal means such as a feedback circuit connected to the sustain pickup means for providing a feedback or "drive" signal representing the motion of the vibratory element to the sustain signal input of the pickup system. Thus, when the pickup coil is connected to the sustain signal input terminal, the pickup acts as a driver. The drive signal is transmitted to the pickup coil and the pickup coil generates magnetic forces which drive the vibratory element so as to sustain the vibration thereof. Because the pickup coil itself may be a relatively low inductance device, it provides good conversion efficiency and substantial driving forces. Coils used in this variant of the invention desirably have the lower inductances and numbers of turns mentioned above, i.e., about 50 to 150 turns, most desirably about 100 turns, and less than about 5 milliHenries inductance, desirably about 1 milliHenry. The pickup system according to the aspect of the present invention thus can be selectively used either as a pickup or as a drive, with good performance in either mode of operation. This avoids the need for yet another pickup to provide a multiple pickup effect and hence provides still further economy in construction of the instrument.

Yet a further aspect of the present invention provides a combined phase inversion and frequency spectrum modification circuit for incorporation in the feedback or drive signal, means of a sustainer. A circuit according to this aspect of the present invention preferably includes an operational amplifier having inverting and noninverting input terminals, and output terminal and an amplifier feedback branch connected between said output terminal and one of said input terminals of the operational amplifier. The circuit further includes a first network having a first network input terminal and also having a first network output terminal connected to one input terminal of the operational amplifier. A second network having a second input terminal and a second network output terminal connected to the other input terminal of the operational amplifier is also provided. The first and second networks have different frequency transfer functions. That is, at least one of the networks is arranged to alter the frequency spectrum of signals passing through it from its network input to its network output terminal, and the nature of such alteration for one of the networks is different from the nature of the alteration provided by the other one of the networks. Each network preferably includes reference means for connecting its network output terminal, and hence the connected operational amplifier input terminal, to a reference potential such as ground. The reference means of each network may include a reference resistor connected between the network output terminal of the network and a source of the reference such a ground. The circuit further includes switch means for selectively directing a signal to either one of the network input terminals and disconnecting the other one of the network input terminals. Thus, the signal may be routed either through the inverting or noninverting input terminals of the operational amplifier and hence may be inverted or not. Also, the frequency spectrum of the signal will be adjusted differently depending on whether it is sent through the inverting or noninverting terminals.

Most preferably, one of the networks includes a first branch having a capacitor and a resistance connected in series between its network input terminal and its network output terminal, and also includes a second branch in parallel with the first branch, the second branch being resistive. The network has a lower impedance for higher frequency signals and thus tends to boost high frequency components of the feedback signal while passing substantially all components to at least some degree. The other network desirably includes a single branch extending from its network input terminal to its network output terminal with a capacitor in series in that branch. This capacitive branch, in conjunction with the reference resistor of the network, forms a high pass filter which substantially suppresses transmission of signals below a predetermined threshold frequency. Most typically, the first network which passes all frequencies but enhances the proportion of high frequency signals is used to sustain fundamental mode vibration of the string, whereas the second network is used to sustain harmonic mode vibration, while the feedback signal is inverted between the pickup and the driver. The second network desirably is configured to suppress signal components in the range of the lower fundamental frequencies of the instrument. Thus the drive forces applied by the driver will not include substantial components at the lower fundamental frequencies. As further discussed below, the second network provides a phase shift effect. In cooperation with other phase shifting components at the circuit, this assures that the drive signal is substantially in quadrature with the pickup signal when the second network is employed.

The feedback circuit incorporating the two networks thus provides a noninverting signal path and an inverting signal path, these two signal paths having different frequency response and phase shift characteristics. Either signal path may be selectively engaged. The noninverting signal path has the optimum characteristics for sustaining fundamental mode vibration, whereas the inverting signal path has optimum characteristics for sustaining harmonic vibrations.

Circuits according to this aspect of the invention thus provide both selection of inversion or noninversion of the signal, and selective modification of the feedback or drive signal frequency spectrum. In the preferred arrangements, this is accomplished with a few relatively inexpensive components.

These and other objects, features and advantages of the present invention will be more readily apparent from the detailed description of the preferred embodiments set forth below, taken in conjunction with the accompanying drawings.

DETAILED DESCRIPTION OF THE PREFERRED EMBODIMENTS

Figure 1:
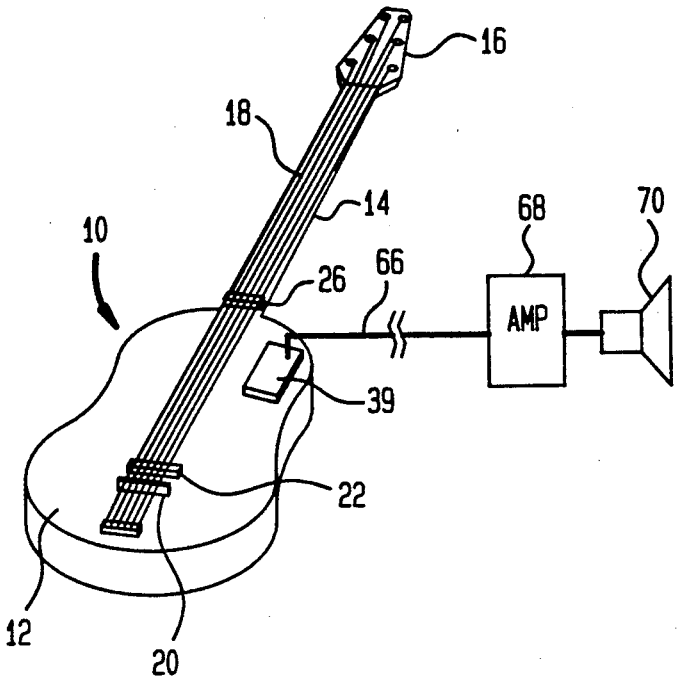
FIG. 1 is a diagrammatic view of apparatus in accordance with one embodiment of the present invention.

A musical instrument in accordance with one embodiment of the present invention includes an instrument structure 10 incorporating a body 12, an elongated neck 14 mounted to the body and a head 16 mounted to the end of neck 14 remote from body 12. A plurality of strings 18 are mounted to structure 10 in the conventional fashion, so that the strings extend along neck 14 and across body 12. A bridge 20 supports strings 18 above the body.

A bridge pickup 22 is mounted to body 12 beneath strings 18 adjacent the bridge 20. Bridge pickup 22 may be a conventional high inductance pickup having a permanent magnet core and a multiturn coil system 24 (FIG. 3) wound around the core. The bridge pickup may be of a conventional "hum-bucking" type including two separate permanent magnet cores having opposite directions of magnetization and a coil system 24 (FIG. 3) including two coils **24*a* and 24*b*** wound on the two ferromagnetic cores in opposite winding directions, of the coil segments being connected together in series so that changes in magnetic flux caused by motion of the strings produce mutually reinforcing voltages in the two smaller coils whereas stray magnetic fields induce oppositely directed, mutually cancelling voltages in the two coil segments.

Figure 2:
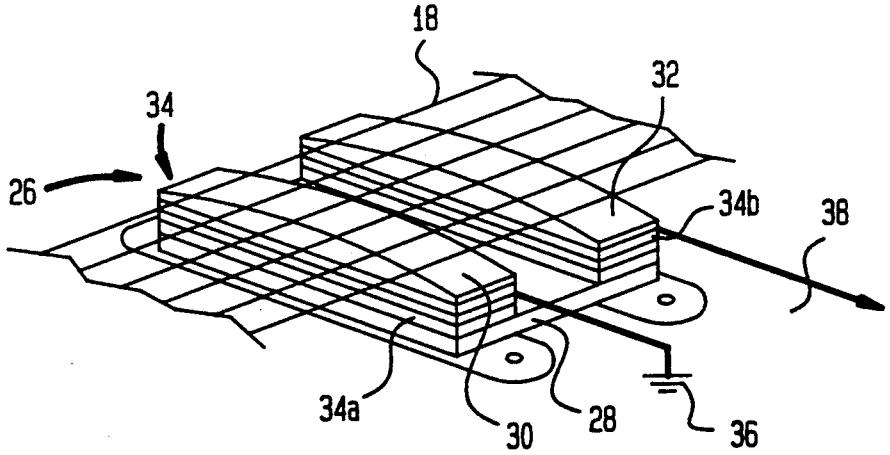
FIG. 2 is a diagrammatic view on an enlarged scale of a component utilized in the apparatus of FIG. 1.

The instrument further includes a neck pickup 26 mounted to the neck 14 of the instrument adjacent its juncture with body 10. Neck pickup 26 is disposed beneath strings 18 approximately midway along the length of the strings. As best seen in FIG. 2, neck pickup 26 incorporates a permanent magnet 28 and a pair of soft iron cores 30 and 32 projecting upwardly from permanent magnet 28. Each of these cores is an elongated generally rectangular body having its long dimension extending generally transverse to the direction of elongation of strings 18. Thus each core 30 and 32 extends across the entire width of the array of strings and slightly beyond the strings on either side thereof. Magnet 28 has a North pole adjacent core 30 and a south pole adjacent core 32, so that flux from the magnet passes through core 30, upwardly into the array of strings 18 and back through core 32 into the magnet. A coil system 34 is wound around cores 30 and 32. Typically, the turns of the coil system are wound on nonmetallic bobbins (not shown) surrounding the cores. Coil system 34 includes a first coil **34*a* wound in a right hand helix around core 30 and a second coil 34*b* wound in a left hand helix around core 32, these portions being electrically connected in series. Upon vibration of the strings, the flux passing through the cores, and hence through the coils 34*a* and 34*b*** will change. The coils are connected together so that changes in flux resulting from string motion result in mutually reinforcing voltages, whereas stray magnetic flux impinging both coils 34*a* and 34*b* cause mutually cancelling induced voltages. Each individual coil 34*a* and 34*b* desirably has inductance and numbers of turns as discussed above. As used in this disclosure with reference to a coil, such as coil 34*a* and 34*b* used with a ferromagnetic core, references to the inductance of the coil should be understood as referring to the inductance of the coil when the coil is disposed on the core. The coil system coil has a ground connection 36 and an output connection 38.

Figure 3:
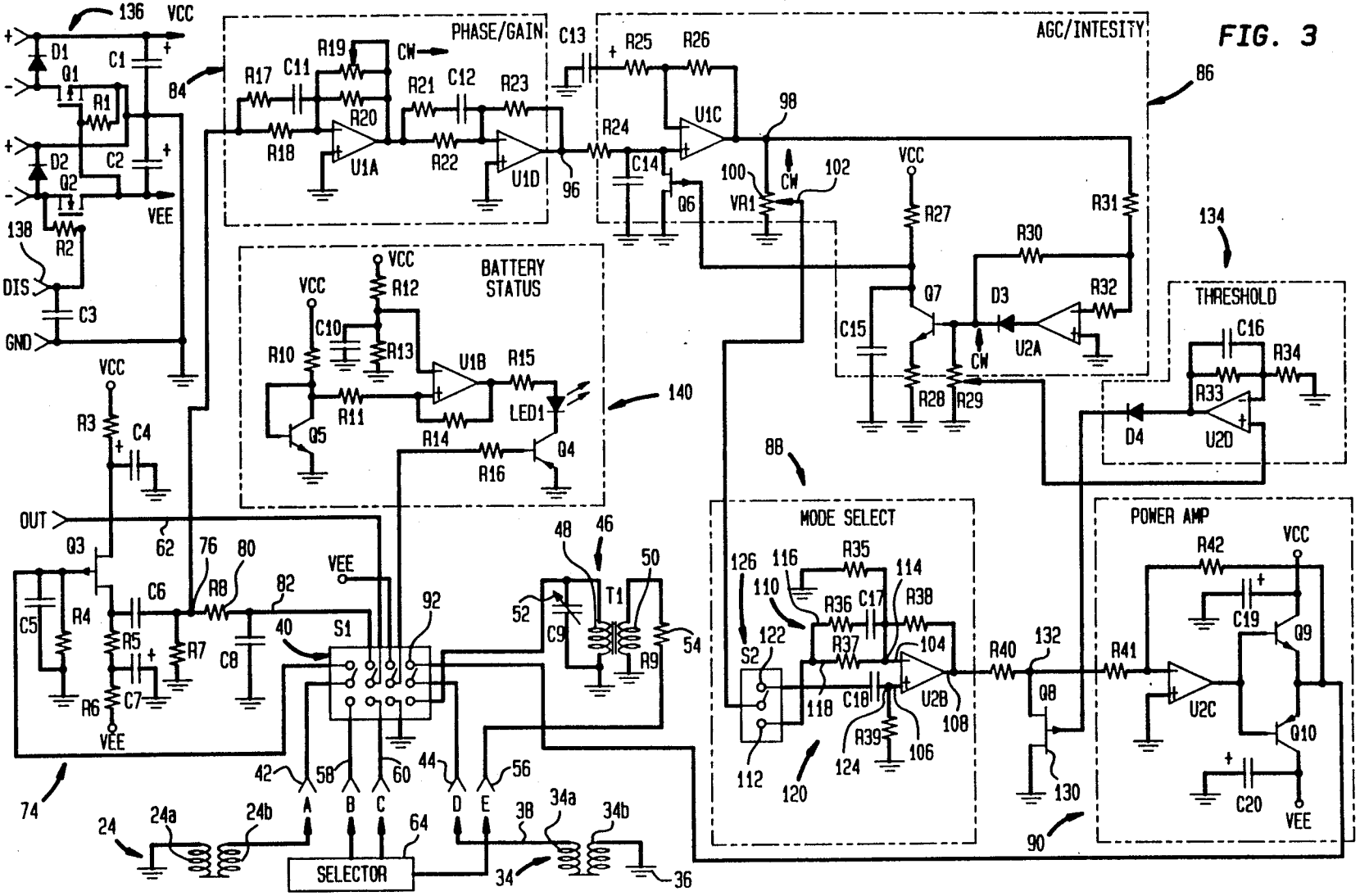
FIG. 3 is a schematic diagram illustrating further components of the apparatus depicted in FIG. 1.

The coil system 24 and 34 of pickups 22 and 26 are connected to the circuit illustrated in FIG. 3. The circuit of FIG. 3 is disposed on the instrument structure 10, as in an enclosure 39 mounted to the instrument structure. The circuit incorporates a four-pole double throw switch 40. A bridge coil input terminal 42 connects the coil system 24 of the bridge pickup to one center terminal of switch 40, whereas a neck input terminal 44 connects the output connection 38 of neck pickup coil 34 to another center terminal of the switch. A transformer 46 is also provided. Transformer 46 has a primary coil section 48 with a relatively small number of turns, and a secondary coil section 50 with a larger number of turns magnetically connected to the primary coil for transmission of magnetic flux therebetween. Transformer 46 is a low-noise transformer such as a nickel core transformer. Transformer 46 may be an autotransformer in which the primary and secondary coil sections are parts of the same winding. Transformer 46 may be arranged to provide a step up voltage ratio of about 15:1 to about 30:1, preferably about 20:1 to about 25:1. Transformer 46 is disposed in relatively close physical proximity to neck pickup 26, and hence to the coil system 34 thereof. This minimizes the lead length between these components, and hence minimizes the influence of stray electromagnetic signals on the relatively low voltage signal passing from coil 34 to transformer 46. Desirably, the lead length from the pickup coil output terminal 38 to the transformer is less than about 50 cm. The primary coil section 48 is connected between a side terminal of switch 40 and ground, and a variable capacitor 52 is connected in parallel with the primary coil. The secondary coil section 50 is connected in series with a resistor 54 between ground and a transformer output terminal 56. Switch 40 is also connected to a bridge coil output terminal 58, a pickup mix input terminal 60 and a system output terminal 62.

A pickup selector switch 64 is connected to terminals 56, 58, and 60. Switch 64 is arranged to selectively connect terminal 56, terminal 58 or both to terminal 60. In one position of switch 40, bridge coil input terminal 42 is connected directly to bridge coil output terminal 58, and neck coil input terminal 44 is connected to the primary coil 48 of transformer 46. In this position, the pickup mix terminal 60 is connected directly to output terminal 62. The remainder of the circuit is inactive when the switch is in this position.

In this condition, signals from bridge pickup 22 (coil system 24) are routed to selector 64. Also, signals from neck pickup coil system 34 are routed to the primary coil of the transformer 46, stepped up by the transformer and routed to selector switch 64. Selector switch 64 can direct either the signal from the bridge pickup, the stepped up signal from the neck pickup or both to output terminal 62. Thus, in this condition the instrument acts as a dual pickup instrument. Depending upon the setting of the selector switch 64, the signal appearing at output terminal 62 may include signals from either pickup or from both pickups in combination. Output terminal 62 is connected via a shielded cable 66 (FIG. 1) to remote amplification devices 68, which in turn may be connected to a conventional loud speaker system 70 and/or a conventional recording device (not shown).

The circuit also includes an amplification and sustainer feedback circuit having an input connection 72. The input of a voltage follower isolation amplifier 74 is connected to input connection 72. The output connection 76 of amplifier 74 is connected through a resistor 80 to an amplifier output terminal 82 on switch 40. The output 76 of amplifier 74 is also connected to a feedback circuit including, in series, a phase shifting amplification circuit 84, an automatic intensity control circuit 86, a mode selection circuit 88 and a drive power amplifier 90. The output of drive power amplifier 90 is connected to a drive signal output terminal 92 on switch 40.

Switch 40 may be set to a second, active position depicted in FIG. 3. In that position, the signal from bridge pickup coil 24 is routed through isolation amplifier 74, to amplified pickup output 82 and then via switch 40 to the output terminal 62 of the instrument. The pickup signal is also applied as a feedback signal through circuits 84, 86, 88, and 90 to drive signal output terminal 92 and is routed by switch 40 to the coil 34 of neck pickup 26. In this active position of switch 40, neck pickup 26 (coil system 34) acts as a driver, and converts the feedback or drive signal into magnetic flux, thus applying magnetic force to strings 18 so as to sustain the vibration of the strings. In this condition, the instrument acts as a single pickup instrument with a sustainer.

Phase shifting circuit 84 is arranged to provide a phase-leading output. That is, the signal appearing at the output node 96 of the phase shifter circuit 84 leads to signal applied at node 76. As used in this disclosure, the terms "leading" and "lagging" are used in their ordinary sense with reference to cyclic or substantially periodic signals. Thus, the time between a zero crossing of the leading signal and the next succeeding zero crossing of the lagging signal is less than one-half the period of the signal. Phase shift circuit 84 includes operational amplifiers U1A and U1D and resistor capacitor networks in so-called "high-frequency shelving" circuits as illustrated. The values of the resistors and capacitors are selected to provide about 100 degrees phase lead for signal components at about 2.6 kHz, about 60 degrees phase lead for signal components at about 1.3 kHz and progressively lesser phase lead at lower frequencies. The precise degree of the amplitude gain of phase shift circuit 84 are controlled by the setting of potentiometer 19, and may be adjusted by the musician.

Automatic intensity control circuit 86 has an output terminal 98. The automatic intensity control circuit is arranged to provide a substantially constant output signal at output node 98 for any input signal applied at node 96, provided that such input signal is within the dynamic range of the components used in the circuit. Operational amplifier U1C operates with a substantially fixed gain. Operational amplifier U2A and diode D3 provide a rectified sample of the output signal appearing at output node 98. This rectified sample voltage in turn is applied to the transistor Q7 to control its impedance and hence control the voltage division between the power supply voltage $V_{cc}$ and ground, thereby controlling the voltage applied to the gate of field effect transistor Q6. This in turn controls the source to drain impedance of transistor Q6. The net effect is that as the amplitude of the signal appearing at output terminal 98 increases, the impedance of transistor Q6 decreases, so that the signal from node 96 is partially shunted to ground through transistor Q6. Thus, the input signal to operational amplifier U1C is attenuated to a greater degree as the output signal increases. This tends to hold the output signal appearing at node 98 constant.

Automatic intensity control circuit output node 98 is connected to one end of the winding of a potentiometer 100. The other end of the winding of this potentiometer is connected to ground. The moveable wiper 102 of this potentiometer is connected to the input of mode select circuit 88. Thus, by adjusting potentiometer 100, the musician can apply varying degrees of attenuation to the signal appearing at mode select circuit 88, and hence can control the intensity of the feedback signal ultimately applied to coil 34.

Mode select circuit 88 incorporates an operational amplifier U2B having an inverting input terminal 104, a noninverting input terminal 106 and an output terminal 108. A amplifier feedback resistor R38 is connected between the output terminal 108 and inverting input terminal 104. The mode select circuit further includes a first network 110 having a first network input terminal 112 and having a first network output terminal 114 connected directly to the inverting input 104 of the operational amplifier. First network 110 incorporates a reference resistor R35 connected between the first network output terminal 114 and ground and hence also connected between the inverting input 104 of the operational amplifier and ground. The first network 110 further includes a first branch 116 and a second branch 118 connected in parallel between input terminal 112 and output terminal 114. First branch 116 includes a resistor R36 and capacitor C17 in series, whereas second branch 118 consists entirely of resistive elements, and includes resistor R37. Mode select circuit 88 further incorporates a second network 120 having a network input terminal 122 and having a network output terminal 124 connected directly to the noninverting input terminal 106 of operational amplifier U2B. Second network 120 includes a reference resistor R39 connected between output terminal 124 and ground and hence connected between the noninverting input terminal 106 of the operational amplifier and ground. Second network 120 further includes a capacitor C18 connected between network input terminal 122 and network output terminal 124. The mode select circuit 88 further includes a switch 126 arranged to direct the feedback or drive signal from automatic intensity control circuit 86 either to the input terminal 112 of first network 110 or to the input terminal 122 of second network 110. When switch 126 connects the feedback signal to the input of one network, the input of the other network is disconnected. First network 110 will pass signal components of all frequencies, but will pass relatively high frequency components above about (e.g., above about 800 HZ), with a greater amplitude than lower frequency components. First network 110 imparts only insignificant phase shifts to signals passing through it. Second network 120 will substantially suppress signal components below a predetermined cutoff frequency, but will pass signal components above this frequency. The cutoff frequency of second network 120 desirably is slightly above the midpoint of the range of fundamental frequencies of the instrument. Where the instrument is a guitar, its highest fundamental frequency is about 1318 HZ, and hence the cutoff frequency of second network 120 desirably is about 700–800 HZ. Second network 120 provides substantial phase shift which progressively decreases with increasing frequency. At the cutoff frequency, the output signal of the network at terminal 124 leads the input signal at terminal 122 by about 45 degrees. The phase lead imparted by phase shifting circuit 84 increases with frequency, whereas the phase lead imparted by second network 120 decreases with frequency. Thus, the sum of the phase leads imparted by the circuit 84 and network 120 when connected in series is approximately constant, and equal to about 80–100 degrees.

The input of power amplifier 90 is connected to the output terminal 108 of mode select operational amplifier U2B through resistors R40 and R41. Field effect transistor 130 connects circuit node 132, between R40 and R41, With ground. When transistor 130 is conducting, the entire signal is shunted to ground and hence no signal reaches power amplifier 90. During normal operation of the feedback circuit, however, transistor 130 is maintained nonconducting as further described below, so that the signal from mode select circuit 88 is directed to the input of the power amplifier, amplified and delivered to the drive signal output terminal 92 on switch 40 and hence to the coil 34 of the neck pickup. Thus, the coils 34*a* and 34*b* generate magnetic flux which is directed via cores 30 and 32 to strings 18, thus applying driving forces to the strings. The components in the signal train between input connections 72 and drive signal output terminal 92 other than mode selection circuit 88 are arranged to invert the signal three times in succession (twice in phase shifting circuit 84 and once in power amplifier 90). Thus, when mode select circuit 88 does not invert the signal (when the signal is directed through first network 110 and through the inverting input terminal 104 of operational amplifier U2B), the feedback signal is inverted four times in succession in passing through the feedback circuit as a whole, and hence is not inverted. In this condition, the drive signal delivered at terminal 92 is in phase with the pickup signal supplied to input terminal 72 except for the phase shift imparted by phase shifting circuit 84. Accordingly, the signal path leading through first network 110 of the mode select circuit can be said to represent a noninverting signal path for the feedback circuit as a whole. Conversely, when the feedback signal is routed through the second network 120, the feedback signal is inverted three times in all, and hence inverted once, in passing from input terminal 72 to output terminal 92, as well as shifted in phase by shifting circuit 84 and network 120. Accordingly, the signal path leading through second network 120 represents the inverting signal path of the feedback circuit as a whole.

The directions of winding of coil systems 24 and 34, and their physical orientation on the instrument are selected so that the relationship between string motion and pickup signal polarity is the same as the relationship between the drive signal polarity and drive force direction. Thus, a pickup signal from coil system 24 of a given polarity corresponds to upward motion of the string, and a drive signal of the same polarity with respect to ground applied to coil system 34 will generate an upward force on the string.

When the noninverting signal path (through first network 110) is employed, the drive signal applied to coil system 34 of the neck pickup 26 is generally in phase with the pickup signal from coil system 24 of bridge pickup 22, except that various components of the drive signal have the phase leads imparted by circuit 84. The drive forces applied by neck pickup 26 to the strings of the instrument lag behind the drive signal. The degree of such lag increases with the frequency of the individual drive signal component. The phase lead imparted by phase shifting circuit 84 substantially compensates for this lag, so that the drive forces applied by neck pickup 26 will be substantially in phase with the motion of the string as detected by bridge pickup 22. In this condition, the drive forces tend to reinforce the fundamental mode vibration of the string. First network 110 utilized in this noninverting path provides a "boost" or relatively greater total amplification to signal components at relatively high fundamental frequencies. This compensates for the relatively poor response of thin, high-frequency strings to magnetic forces.

When the inverting signal path through second network 120 is employed, the drive signal applied to coil 34 is inverted in phase with respect to the pickup signal from coil 24 of bridge pickup 22, again with the phase lead imparted by phase shift circuit 84, and hence the drive forces applied by neck pickup 26 to the strings are counterdirectional (out of phase) to the motion of the strings as detected by bridge pickup 22. In this condition, the sustainer tends to reinforce the harmonic vibrations of the strings. The high-frequency signal with substantially fixed phase lead provided in this condition gives optimum harmonics reinforcement action.

A threshold circuit 134 is provided to control shunting or disabling transistor 130. The threshold circuit 134 is connected to the output of operational amplifier U2A and diode D3 through a potentiometer R29, so that threshold circuit 134 receives an attenuated version of the rectified signal from intensity control circuit 86. Threshold circuit 134 is arranged to maintain the shunting transistor 130 in a nonconducting mode whenever the attenuated sample of the signal provided by the potentiometer R29 is above a certain level and to maintain the shunting transistor 130 in a conducting condition when the attenuated sample of the signal is below that level. When a note is played with a substantial amplitude, the signal provided by intensity control circuit 86 at node 98 rises to a substantial level. The attenuated sample of the signal supplied via potentiometer R29 rises above the threshold, whereupon threshold control circuit 134 switches transistor 130 into a nonconducting mode so that the feedback signal is applied to coil system 34 to sustain vibrations of the string. This condition, and the sustain action, continues even when the motion of the string has decayed to a substantial degree, because intensity control circuit 86 tends to maintain the signal at node 98 constant. The attenuated sample signal provided by potentiometer R29 to threshold circuit 134 does not drop below the threshold until the motion of the string has decayed to such an extent that the signal applied to the input of intensity control circuit 86 is below the dynamic range of that circuit. Stated another way, once the instrument has started to sustain a note, it will continue to sustain the note for a considerable time. However, when no note has been played, the signal at node 98 and hence the sample of the signal provided to threshold control circuit 134 is below the threshold and shunting transistor 130 remains in conducting mode. This prevents the system from reinforcing random noise signals of relatively small magnitude and exciting unwanted vibrations of the strings.

A battery energized power supply circuit 136, mounted on the instrument provides power to the components discussed above. The power supply circuit includes JFET switching elements Q1 and Q2 responsive to a disconnect signal applied via a disconnect input 138 to interrupt the power whenever disconnect input 138 is connected to ground. This is employed in conjunction with an external switch, which may be mounted on the instrument. Using this switch, the musician can disable or enable the sustain action. Power supply circuit 136 is arranged to provide two voltages of opposite polarity with respect to ground ($V_{cc}$ and $V_{ee}$). A battery status circuit 140 is also provided. The battery status circuit is permanently connected to $V_{cc}$. It is also connected to $V_{ee}$ via switch 40 when the instrument is in the active mode. When the battery status circuit is in this condition, it will illuminate a light emitting diode LED1 if the difference between $V_{cc}$ and $V_{ee}$ is above a preset level. When the instrument is in the inactive or the passive mode first discussed above, it is disconnected from $V_{ee}$ and connected to ground, so that LED1 remains unilluminated and hence the circuit does not draw substantial power.

Figure 4:
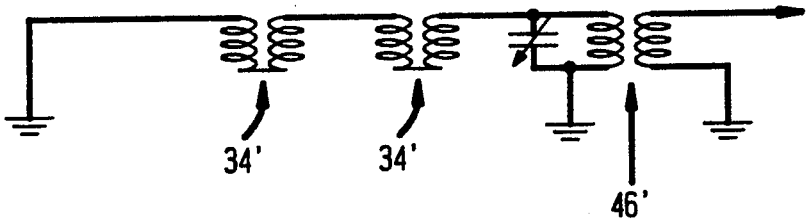
FIG. 4 is a further schematic view depicting portions of apparatus according to a further embodiment of the present invention.

Numerous variations and combinations of the features described above can be utilized without departing from the present invention as defined by the claims. Merely by way of example, the instrument may incorporate additional pickups. Even where such additional pickups are employed, the ability to use at least one such pickup either as a driver or as a pickup minimizes the total number of pickups which must be incorporated in the instrument to provide the desired versatility. All of the pickups on the instrument may be low impedance pickups provided with transformers as discussed above. The coil systems 34' of two or more pickups may be connected in series to the primary coil portion of the transformer 46', as shown in FIG. 4. Also, two or more of the pickups on the instrument may be connected for interchangeable use either as pickups or as drivers, so that the musician may select from different drive locations. The particular core designs illustrated should not be taken as limiting. Thus, each core may include individual pole projections aligned with the individual strings. Although the operational amplifier and dual-network system discussed above is most preferred, other arrangements can be employed to provide the inverting and noninverting signal paths with different frequency and phase characteristics. For example, the two signal paths could include separate operational amplifiers rather than the common operational amplifier U2B discussed above.

In a variant of the present invention, the transformer could be reversed. Thus, a high-inductance pickup could be connected to the secondary (high number of turns) coil section of a step-up transformer, and a drive signal could be supplied to the primary (low number of turns) coil section of such a transformer. The pickup could be selectively disconnected from the transformer for use as a pickup, rather than as a driver. This approach is distinctly less desirable.

As these and other variations and combinations of the features discussed above may be utilized without departing from the present invention, the foregoing description of the preferred embodiments should be taken by way of illustration rather than by way of limitation of the invention as defined by the claims.

I claim:

1. A sustainer for a musical instrument having at least one vibratory element comprising:

(a) drive means for accepting a signal and applying a driving force to a vibratory element of the instrument responsive to said drive signal;

(b) a sustain feedback circuit for accepting a feedback signal representing motion of said vibratory element and conducting said feedback signal to said drive means, whereby said drive means will apply said drive force to said vibratory element responsive to said feedback signal, said sustain feedback circuit including a mode select means for selectively altering said feedback signal, said mode select means including:

(1) An operational amplifier having inverting and noninverting input terminals, an output terminal, and an amplifier feedback circuit connected between said output terminal and one of said input terminals of said operational amplifier;

(2) A first network having a first network input terminal and a first network output terminal connected to one input terminal of said operational amplifier;

(3) A second network having a second network input terminal, and a second network output terminal connected to the other input terminal of said operational amplifier, said first and second networks having different frequency transfer functions, each of said networks having reference means for connecting its network output terminal to a reference potential; and (4) Switch means for selectively directing said feedback signal to said operational amplifier through one of said networks and disconnecting the other one of said networks.

2. A sustainer as claimed in claim 1 wherein said reference means of each said network includes a reference resistor connected between the network output terminal of that network and a source of said reference potential.

3. A sustainer as claimed in claim 2 wherein said first network includes a first branch having a capacitor and a resistor connected in series between said first network input terminal and said first network output terminal and a second branch in parallel with said first branch, said second branch having a resistor 4. A sustainer as claimed in claim 3 wherein said second network includes a capacitor connected between said second network input terminal and said second network output terminal.

5. A sustainer for a musical instrument having at least one vibratory element comprising:

(a) drive means for accepting a signal and applying a driving force to a vibratory element of the instrument responsive to said drive signal; and (b) a sustain feedback circuit for accepting a feedback signal representing motion of said vibratory element and conducting said feedback signal to said drive means, whereby said drive means will apply said drive force to said vibratory element responsive to said feedback signal, said sustain feedback circuit including an inverting signal path and a noninverting signal path, said noninverting signal path and said inverting signal path having different frequency response characteristics, and mode switch means for selectively directing said feedback signal through either one of said signal paths to said drive means while disabling the other one of said signal paths.

6. A sustainer as claimed in claim 5 wherein said noninverting signal path is operative to pass signal components at all frequencies within the range of fundamental frequencies of the instrument, said inverting signal path being operative to substantially block signal components below a preselected cutoff frequency..

7. A sustainer as claimed in claim 5 wherein said inverting and noninverting signal paths have different phase shift characteristics.

8. A sustainer as claimed in claim 7 wherein each said signal path is operative to impart a phase lead to said feedback signal, the phase lead imparted by said noninverting signal path increasing with frequency, the phase lead imparted by said inverting signal path being substantially constant for all frequencies passed by said inverting signal path.

9. A sustainer as claimed in claim 8, further comprising phase shifting circuit means for providing a phase lead which increases with frequency, said inverting and noninverting signal paths each including said phase shifting circuit means, said inverting signal path including means for providing phase lead which decreases with increasing frequency.

* * * * *

UNITED STATES PATENT AND TRADEMARK OFFICE

CERTIFICATE OF CORRECTION

PATENT NO. : 5,200,569

DATED : April 6, 1993

INVENTOR(S) : Moore

It is certified that error appears in the above-identified patent and that said Letters Patent is hereby corrected as shown below:

Column 1, line 7, "continuation" should read --division--.
Column 1, line 7, delete "in part".
Column 2, line 9, "sustain" should read --sustaining--.
Column 2, line 12, "devices" should read --device--.
Column 2, line 60, "there between" should read --therebetween--.
Column 5, line 4, the second occurence of "a" should read --as--.
Column 8, line 47, "kHz" should read --$kH_z$--.
Column 8, line 48, "kHz" should read --$kH_z$--.
Column 10, line 17, "With" should read --with--.
Column 13, line 47, after "resistor" insert --.--.

Column 14, line 29, delete ".".

Signed and Sealed this

Nineteenth Day of July, 1994

Bruce Lehman

*Attest:*

BRUCE LEHMAN

*Attesting Officer*

*Commissioner of Patents and Trademarks*